US010697333B2

(12) United States Patent
Kandolf

(10) Patent No.: US 10,697,333 B2
(45) Date of Patent: Jun. 30, 2020

(54) HYDRAULICALLY ACTUATED CAMSHAFT PHASERS FOR CONCENTRICALLY ARRANGED CAMSHAFTS

(71) Applicant: Schaeffler Technologies AG & Co. KG, Herzogenaurach (DE)

(72) Inventor: Michael Kandolf, Saint Clair, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 14 days.

(21) Appl. No.: 16/200,728

(22) Filed: Nov. 27, 2018

(65) Prior Publication Data

US 2019/0170028 A1 Jun. 6, 2019

Related U.S. Application Data

(60) Provisional application No. 62/593,532, filed on Dec. 1, 2017.

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/3442* (2013.01); *F01L 2001/0473* (2013.01); *F01L 2001/34456* (2013.01); *F01L 2001/34466* (2013.01); *F01L 2001/34469* (2013.01); *F01L 2001/34483* (2013.01); *F01L 2001/34489* (2013.01); *F01L 2250/02* (2013.01); *F01L 2820/041* (2013.01)

(58) Field of Classification Search

CPC ..... F01L 1/3442; F01L 2001/34466; F01L 2001/34489; F01L 2820/041

USPC ..... 123/90.15, 90.17, 90.12

See application file for complete search history.

(56) References Cited

U.S. PATENT DOCUMENTS

| | | | | |
|---|---|---|---|---|
| 5,417,186 | A | 5/1995 | Elrod et al. | |
| 7,789,054 | B2 | 9/2010 | Rozario et al. | |
| 7,814,874 | B2 * | 10/2010 | Kubani | F01L 1/344 123/90.17 |
| 7,841,311 | B2 | 11/2010 | Hutcheson et al. | |

(Continued)

FOREIGN PATENT DOCUMENTS

| | | |
|---|---|---|
| DE | 19581459 T1 | 2/1997 |
| DE | 102009041873 A1 | 4/2010 |

*Primary Examiner* — Ching Chang

(57) ABSTRACT

A camshaft phaser assembly, including: an axis of rotation; a first hydraulic camshaft phaser including a stator arranged to receive rotational torque and including a plurality of radially inwardly extending protrusions, a rotor including a plurality of radially outwardly extending protrusions circumferentially interleaved with the plurality of radially inwardly extending protrusions, and a plurality of phaser chambers, each phaser chamber circumferentially bounded by a respective radially inwardly extending protrusion included in the plurality of radially inwardly extending protrusions and a respective radially outwardly extending protrusion included in the plurality of radially outwardly extending protrusions; a second hydraulic camshaft phaser; a cap; and a fluid chamber bounded in part by the cap and in fluid communication with a phaser chamber included in the plurality of phaser chambers; and a bolt arranged to non-rotatably connect the rotor and the cap to a camshaft.

20 Claims, 13 Drawing Sheets

(56) References Cited

U.S. PATENT DOCUMENTS

| | | | |
|---|---|---|---|
| 8,051,818 | B2 | 11/2011 | Myers et al. |
| 8,186,319 | B2 | 5/2012 | Pluta et al. |
| 8,261,705 | B2 | 9/2012 | Lancefield et al. |
| 8,375,906 | B2 | 2/2013 | Myers et al. |

* cited by examiner

HYDRAULICALLY ACTUATED CAMSHAFT PHASERS FOR CONCENTRICALLY ARRANGED CAMSHAFTS

CROSS-REFERENCE TO RELATED APPLICATIONS

This application claims the benefit under 35 U.S.C. § 119(e) of U.S. Provisional Patent Application No. 62/593,532, filed Dec. 1, 2017, which application is incorporated herein by reference in its entirety.

TECHNICAL FIELD

This disclosure is generally related to a camshaft phaser assembly with dual hydraulic camshaft phasers and, more particularly, to a camshaft phaser assembly with target wheels axially bracketing the dual hydraulic camshaft phasers.

BACKGROUND

A camshaft phaser assembly with dual hydraulic camshaft phasers is known. A target wheel for one of the hydraulic camshaft phasers is axially disposed between portions of the dual hydraulic camshaft phasers, increasing the axial extent of the camshaft phaser assembly and complicating access to the target wheel and cam timing implemented using the target wheel.

SUMMARY

According to aspects illustrated herein, there is provided a camshaft phaser assembly, including: an axis of rotation; a first hydraulic camshaft phaser including a first stator arranged to receive rotational torque and including a first plurality of radially inwardly extending protrusions, a first rotor including a first plurality of radially outwardly extending protrusions circumferentially interleaved with the first plurality of radially inwardly extending protrusions, and a first plurality of phaser chambers, each phaser chamber circumferentially bounded by a respective radially inwardly extending protrusion included in the first plurality of radially inwardly extending protrusions and a respective radially outwardly extending protrusion included in the first plurality of radially outwardly extending protrusions; a second hydraulic camshaft phaser; a cap; and a first fluid chamber bounded in part by the cap and in fluid communication with a first phaser chamber included in the first plurality of phaser chambers; and a first bolt arranged to non-rotatably connect the first rotor and the cap to a first camshaft.

According to aspects illustrated herein, there is provided a camshaft phaser assembly, including: an axis of rotation; a first hydraulic camshaft phaser including a first stator arranged to receive rotational torque and including a plurality of radially inwardly extending protrusions, a first rotor including a plurality of radially outwardly extending protrusions circumferentially interleaved with the plurality of radially inwardly extending protrusions, and a plurality of phaser chambers, each phaser chamber circumferentially bounded by a respective radially inwardly extending protrusion included in the plurality of radially inwardly extending protrusions and a respective radially outwardly extending protrusion included in the plurality of radially outwardly extending protrusions; a second hydraulic camshaft phaser including a second stator non-rotatably connected to the first stator, and a second rotor; a cap including a first through-bore; a first bolt arranged to non-rotatably connect the first rotor and the cap to a first camshaft; a first fluid chamber bounded in part by the cap, directly connected to the first through-bore, and in fluid communication with a first phaser chamber included in the plurality of phaser chambers; and a second fluid chamber bounded in part by the cap and in fluid communication with a second phaser chamber, circumferentially adjacent to the first phaser chamber, included in the plurality of phaser chambers.

According to aspects illustrated herein, there is provided a camshaft phaser assembly, including: an axis of rotation; a first hydraulic camshaft phaser including a first stator arranged to receive rotational torque and including a first plurality of radially inwardly extending protrusions, a first rotor including a first plurality of radially outwardly extending protrusions circumferentially interleaved with the plurality of radially inwardly extending protrusions, and a first plurality of phaser chambers circumferentially bounded by the first plurality of radially inwardly extending protrusions and the first plurality of radially outwardly extending protrusions; a second hydraulic camshaft phaser including a second stator arranged to receive the rotational torque and including a second plurality of radially inwardly extending protrusions, a second rotor including a second plurality of radially outwardly extending protrusions circumferentially interleaved with the second plurality of radially inwardly extending protrusions, and a second plurality of phaser chambers circumferentially bounded by the second plurality of radially inwardly extending protrusions and the second plurality of radially outwardly extending protrusions; a first target wheel non-rotatably connected to the first rotor and arranged to determine a circumferential position of the first rotor for use in rotating the first rotor with respect to the first stator; and a second target wheel non-rotatably connected to the second rotor and arranged to determine a circumferential position of the second rotor for use in rotating the second rotor with respect to the second stator. The first hydraulic camshaft phaser and the second hydraulic cam shaft phaser are located between the first target wheel and the second target wheel in an axial direction parallel to the axis of rotation.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
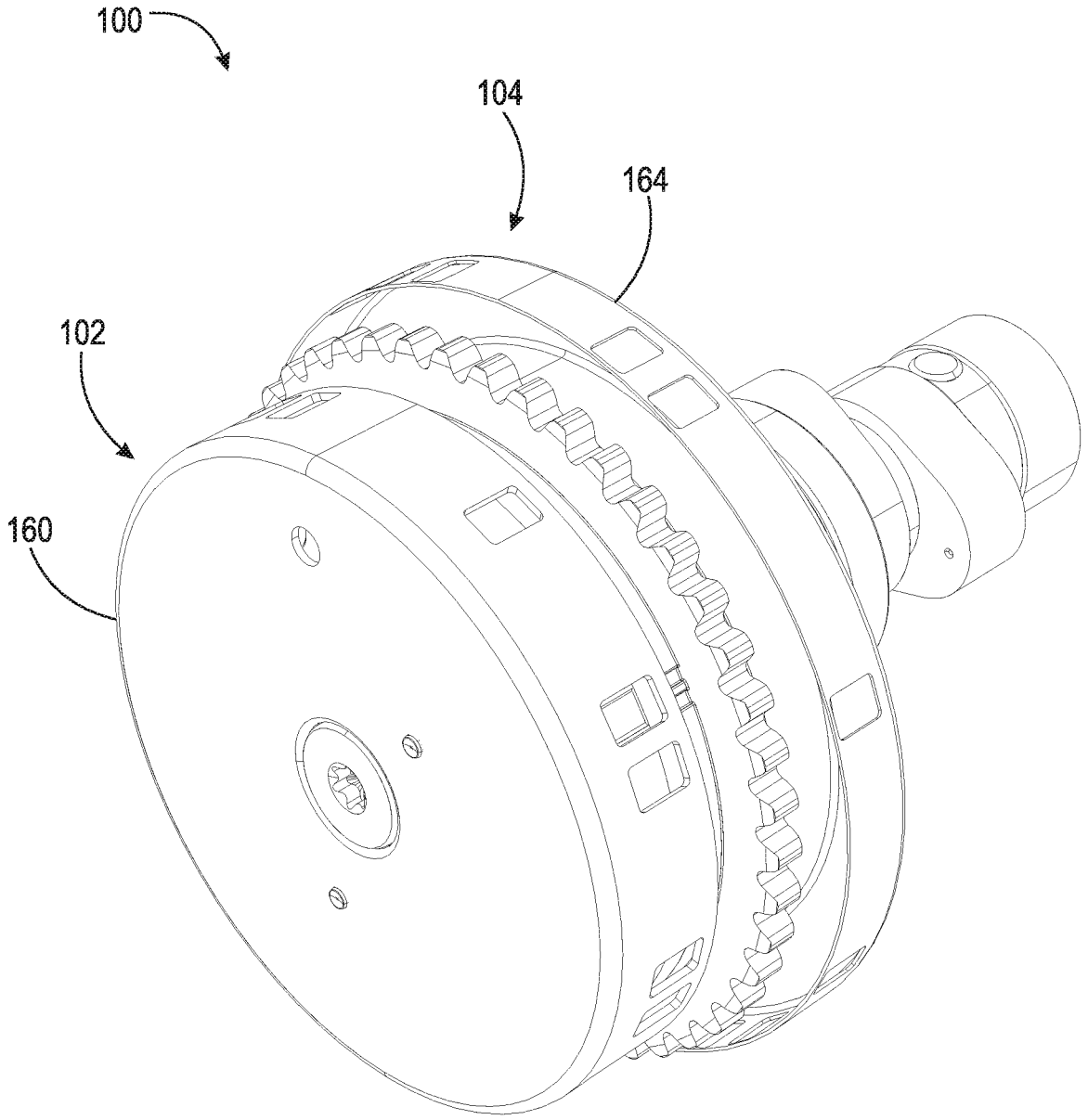
FIG. 1 is a front perspective view of a camshaft phaser assembly with dual hydraulic camshaft phasers.

FIG. 1 is a front perspective view of camshaft phaser assembly 100 with dual hydraulic camshaft phasers.

Figure 2:
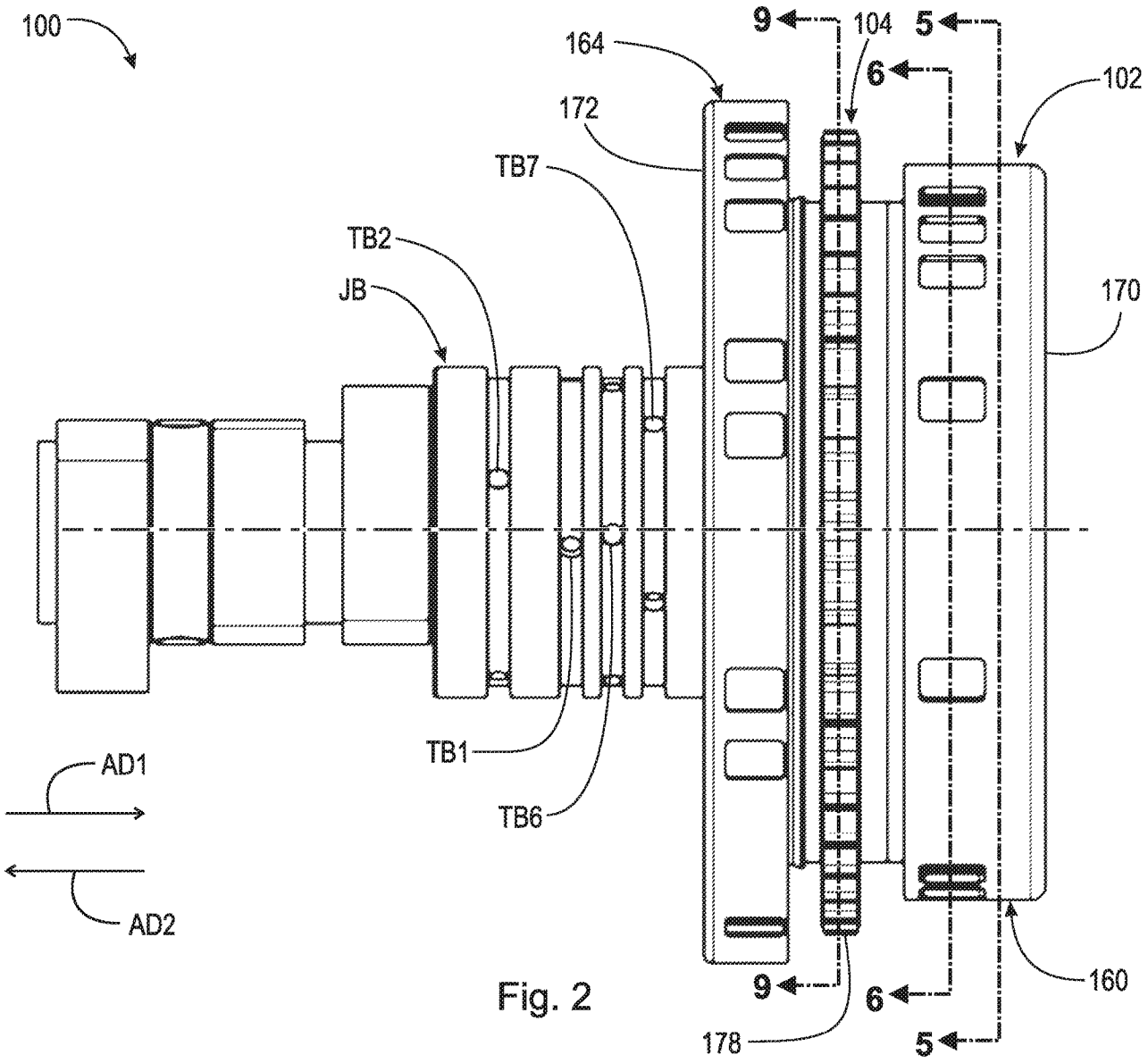
FIG. 2 is a side view of the camshaft phaser assembly shown in FIG. 1.

FIG. 2 is a side view of camshaft phaser assembly 100 shown in FIG. 1.

Figure 3:
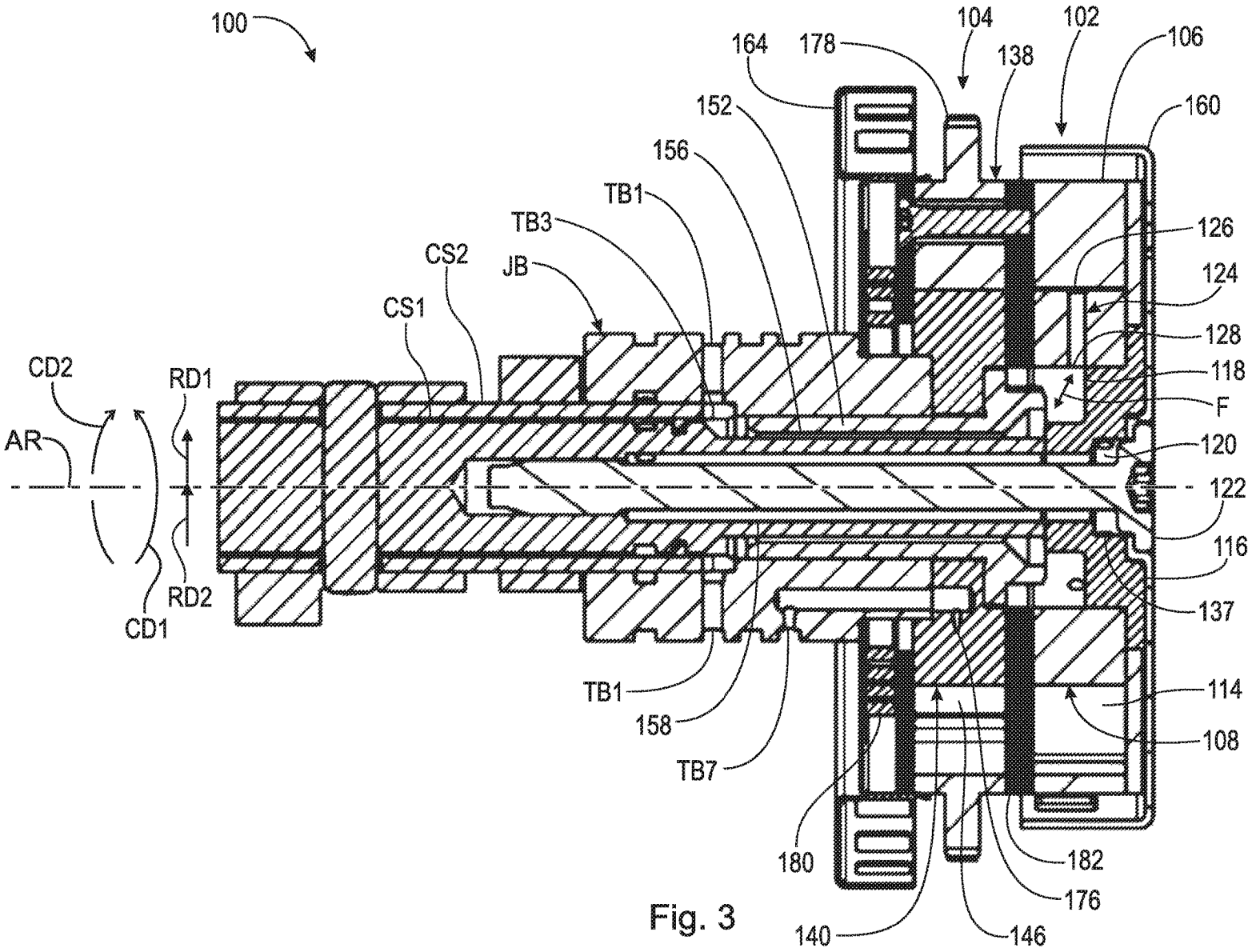
FIG. 3 is an axial cross-sectional view of the camshaft phaser assembly shown in FIG. 1.

FIG. 3 is an axial cross-sectional view of camshaft phaser assembly 100 shown in FIG. 1.

Figure 4:
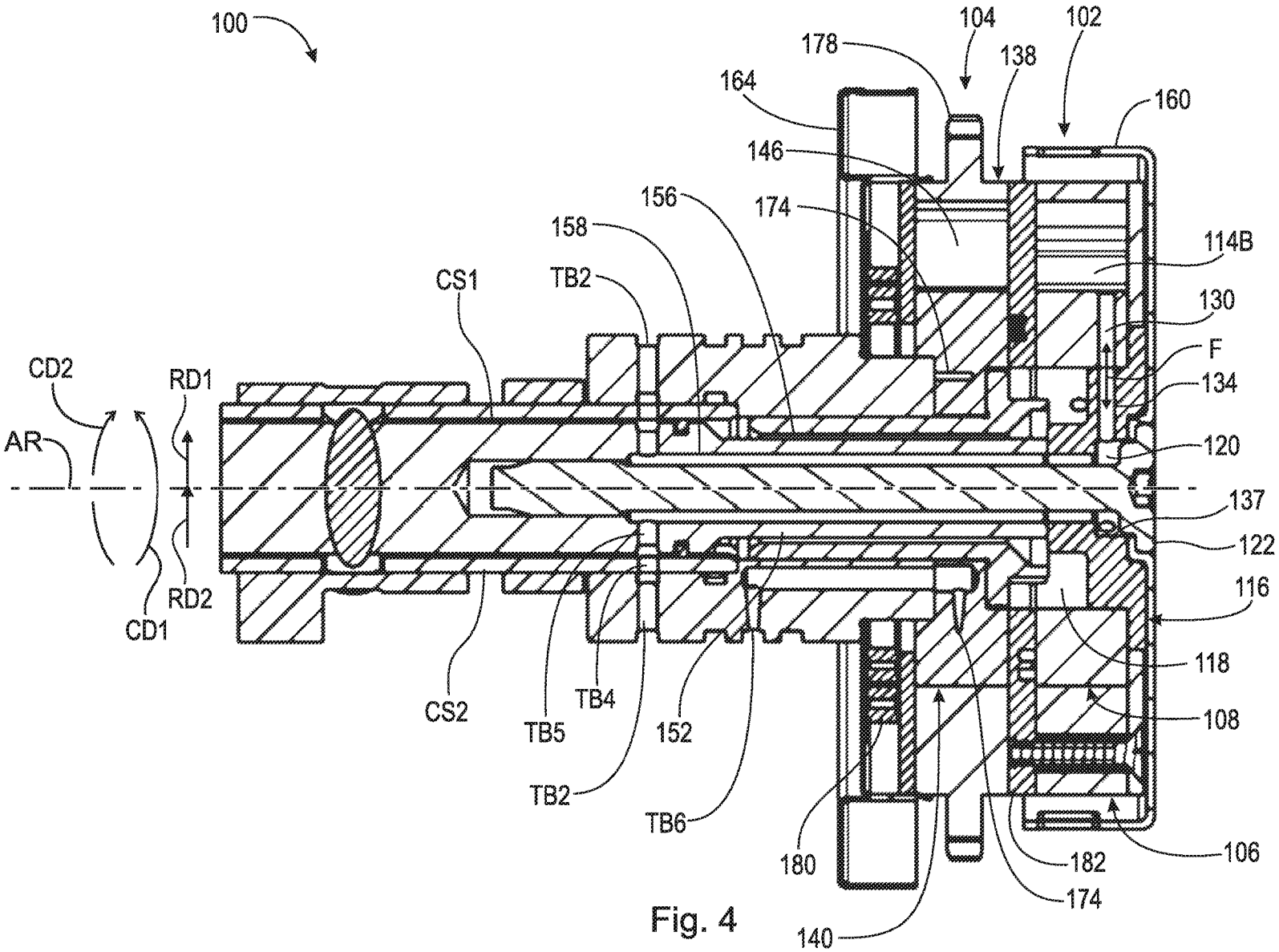
FIG. 4 is an axial cross-sectional view of the camshaft phaser assembly shown in FIG. 1.

FIG. 4 is an axial cross-sectional view of camshaft phaser assembly 100 shown in FIG. 1.

Figure 5:
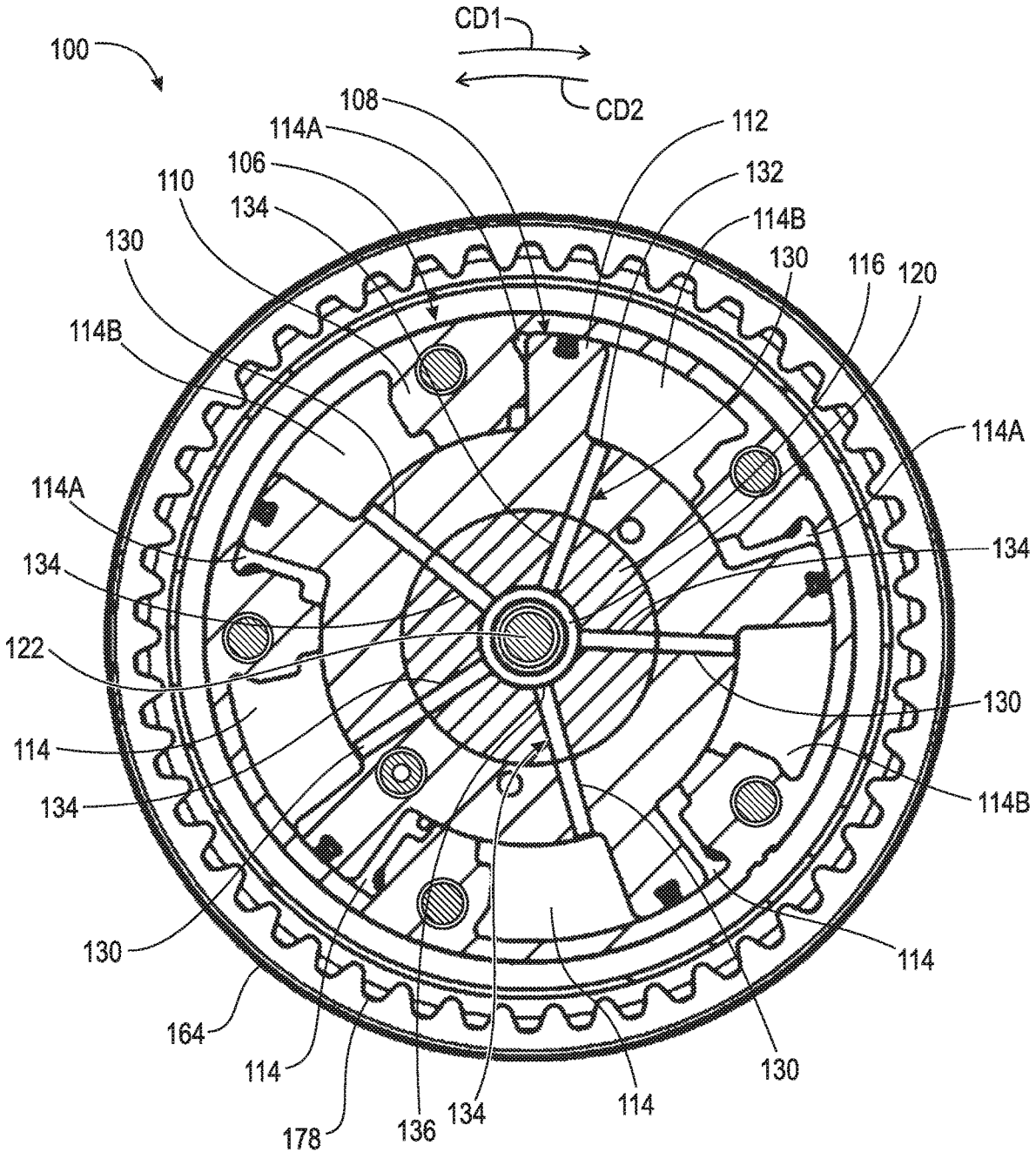
FIG. 5 is a cross-sectional view generally along line 5-5 in FIG. 2.

FIG. 5 is a cross-sectional view generally along line 5-5 in FIG. 2. The following should be viewed in light of FIGS. 1 through 5. Camshaft phaser assembly 100 includes axis of rotation AR, hydraulic camshaft phaser 102, and hydraulic camshaft phaser 104. Phaser 102 includes stator 106 and rotor 108. Stator 106 is arranged to receive rotational torque and includes radially inwardly extending protrusions 110. Rotor 108 includes radially outwardly extending protrusions 112 circumferentially interleaved with radially inwardly extending protrusions 110. That is, protrusions 110 and 112 alternate in circumferential direction CD1. Phaser 102 includes phaser chambers 114. In the example of FIG. 1, phaser chambers 114 include pairs of chambers 114. Each pair of chambers 114 includes an advance chamber 114A and a circumferentially adjacent retard chamber 114B, the functions of which are discussed below. Each phaser chamber 114 is circumferentially bounded by a respective radially inwardly extending protrusion 110 and a respective radially outwardly extending protrusion 112. For example: each phaser chamber 114A is bounded by a respective protrusion 112 in direction CD1 and by a respective protrusion 110 in direction CD2, opposite direction CD1; and, each phaser chamber 114B is bounded by a respective protrusion 110 in direction CD1 and by a respective protrusion 112 in direction CD2. In general, a reference character "[digit][digit][digit][letter]" designates a specific example of an element labeled as "[digit][digit][digit]." For example, advance phaser chambers 114A are specific examples from among phaser chambers 114.

Assembly 100 includes: cap 116; fluid chamber 118; fluid chamber 120; and bolt 122. Chamber 118 and chamber 120 are each bounded, at least in part, by cap 116. Chamber 120 is bounded at least in part by bolt 122. Chamber 118 is in fluid communication with phaser chambers 114A. Chamber 120 is in fluid communication chambers 114B. Bolt 122 is arranged to non-rotatably connect rotor 108 and camshaft CS1. By "fluid communication" between two components, we mean that a fluid flow path exists between and connects the two components.

Rotor 108 includes through-bores 124. Each through-bore 124 is in fluid communication with a respective chamber 114A. For example, each through-bore 124 includes end 126 open to the chamber 114A and end 128 open to chamber 118. Stated otherwise, each through-bore 124 directly connects chamber 118 and the respective chamber 114A. Rotor 108 includes through-bores 130. Each through-bore 130 is open to a respective chamber 114B. For example, each through-bore 130 includes end 132 open to the respective chamber 114B.

Cap 116 includes through-bores 134 open to chamber 120. For example, each through-bore 134 includes end 136 open to chamber 120. Chambers 114B, through-bores 130, through-bores 134, and chamber 120 are in fluid communication. For example: through-bores 134 directly connect chamber 120 and through-bores 130; and through-bores 130 directly connect chambers 114B and through-bores 134. Cap 116 includes surface 137 facing axis AR. Ends 136 are in surface 137. Surface 137 bounds a portion of fluid chamber 120.

Figure 6:
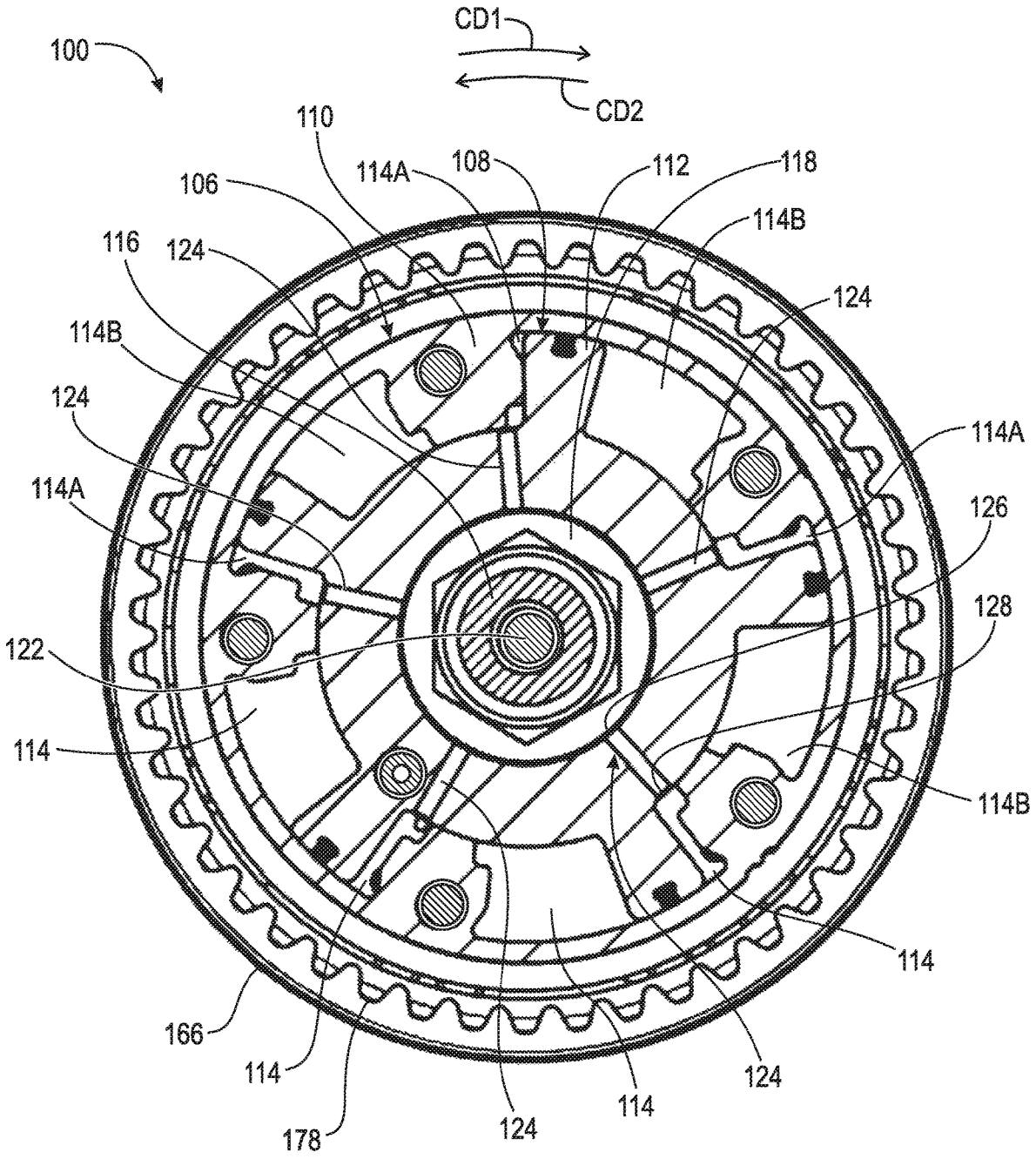
FIG. 6 is a cross-sectional view generally along line 6-6 in FIG. 2.

FIG. 6 is a cross-sectional view generally along line 6-6 in FIG. 2.

Figure 7:
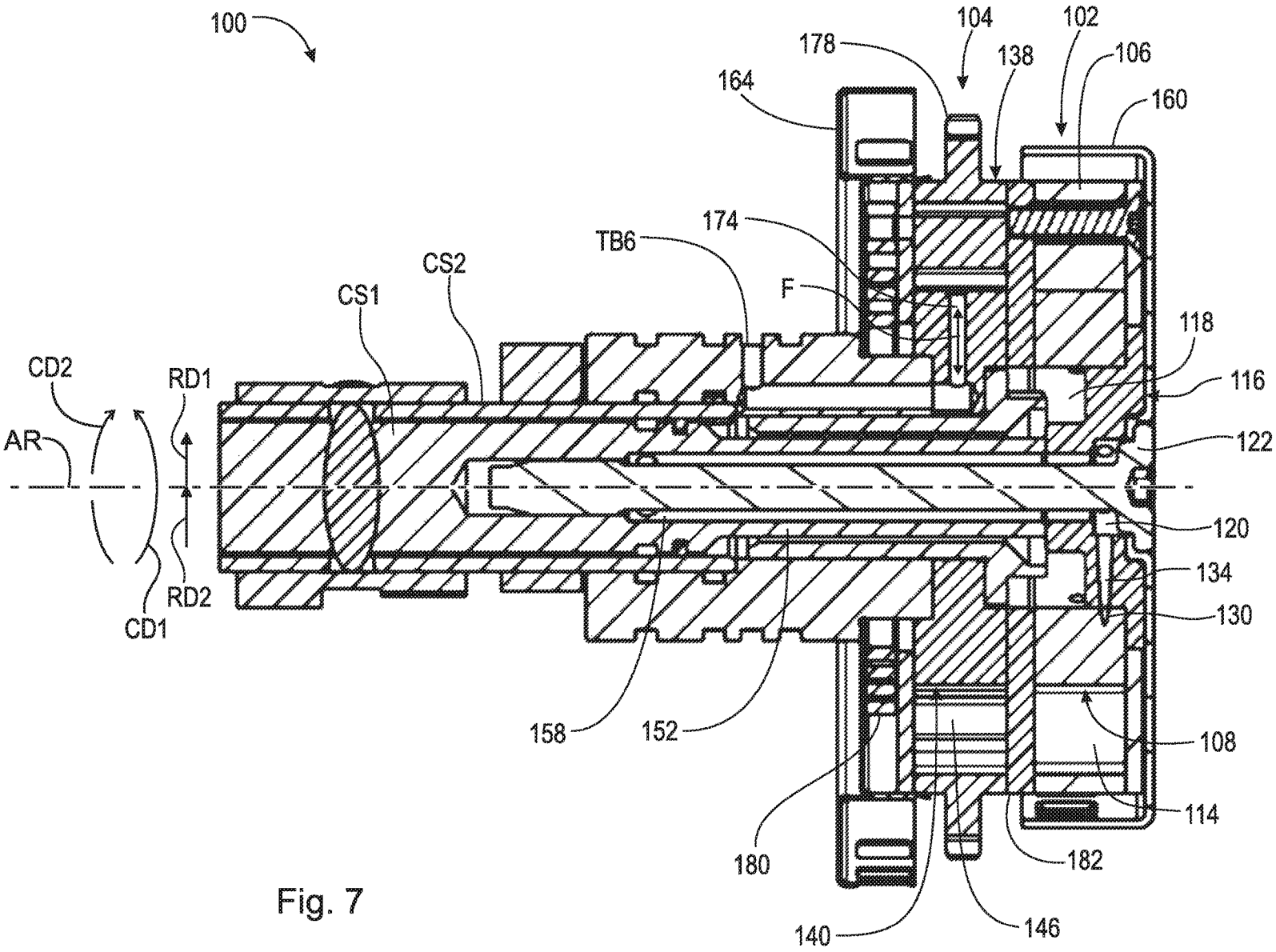
FIG. 7 is an axial cross-sectional view of the camshaft phaser assembly shown in FIG. 1.

FIG. 7 is an axial cross-sectional view of camshaft phaser assembly 100 shown in FIG. 1.

Figure 8:
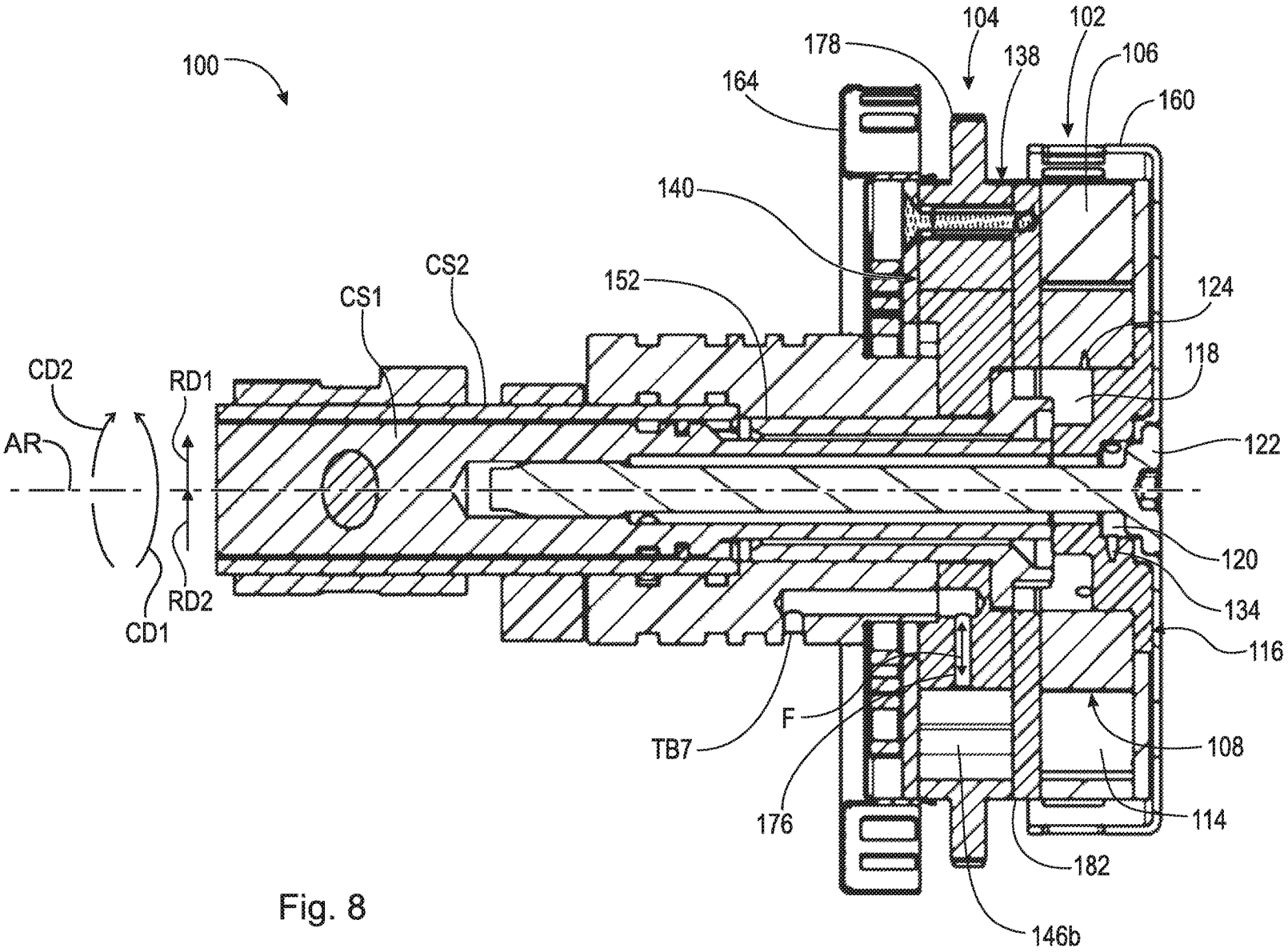
FIG. 8 is an axial cross-sectional view of the camshaft phaser assembly shown in FIG. 1.

FIG. 8 is an axial cross-sectional view of camshaft phaser assembly 100 shown in FIG. 1.

Figure 9:
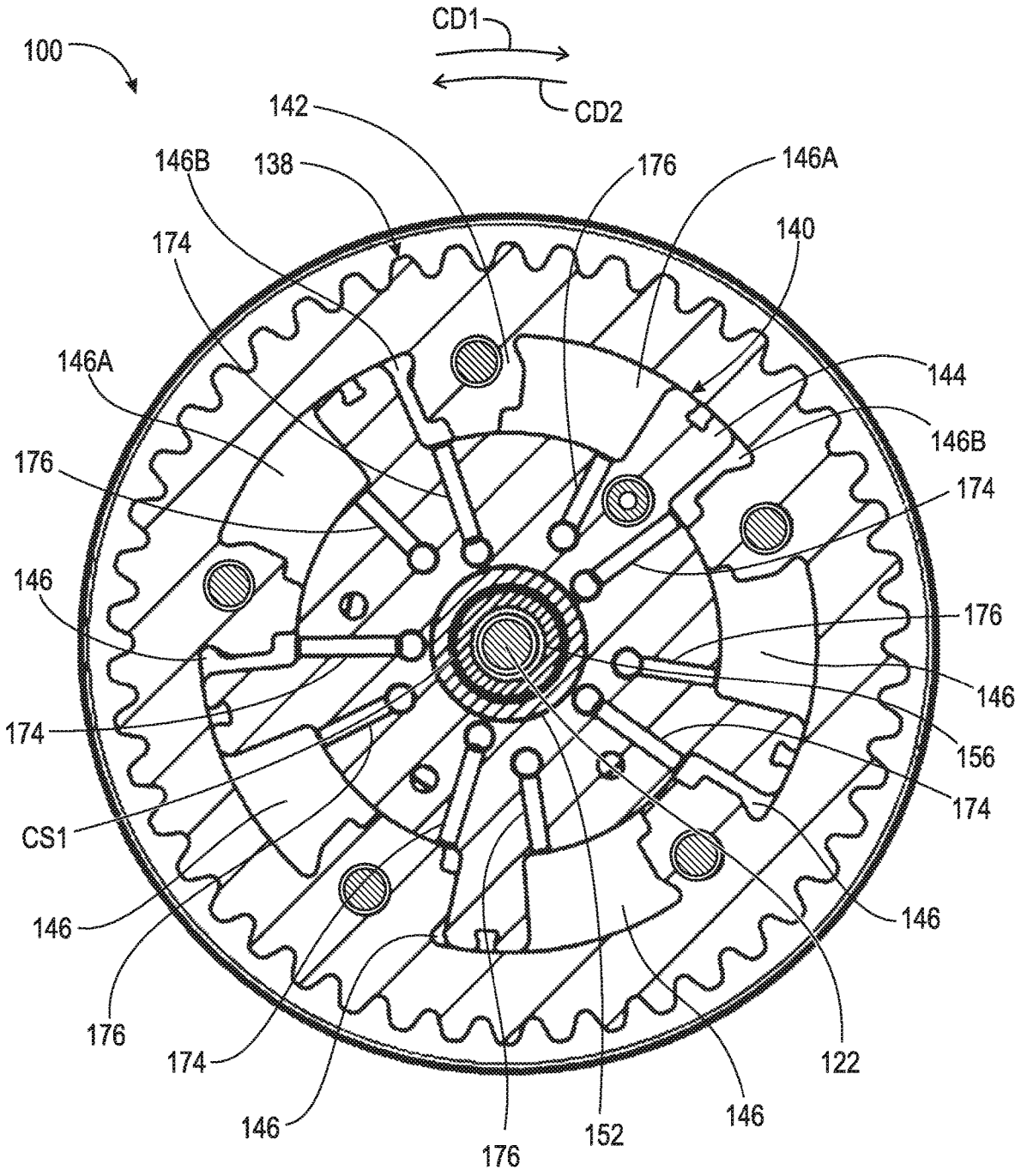
FIG. 9 is a cross-sectional view generally along line 9-9 in FIG. 2.

FIG. 9 is a cross-sectional view generally along line 9-9 in FIG. 2. The following should be viewed in light of FIGS. 1 through 9. Phaser 104 includes stator 138 and rotor 140. Stator 138 is non-rotatably connected to stator 106 and includes radially inwardly extending protrusions 142. Rotor 140 includes radially outwardly extending protrusions 144 circumferentially interleaved with radially inwardly extending protrusions 142. That is, protrusions 142 and 144 alternate in circumferential direction CD1. Phaser 104 includes phaser chambers 146. Each phaser chamber 146 is circumferentially bounded by a respective radially inwardly extending protrusion 142 and a respective radially outwardly extending protrusion 144. In the example of FIG. 1, phaser chambers 146 include pairs of chambers 146. Each pair of chambers 146 includes an advance chamber 146A and a circumferentially adjacent retard chamber 146B, the functions of which are discussed below.

Assembly 100 includes bolt 152 arranged to non-rotatably connect rotor 140 to camshaft CS2, concentric with camshaft CS1. In the example of FIG. 1: bolt 152 is a hollow bolt; at least a portion of bolt 122 is disposed bolt 152; and camshaft CS1 is radially inward of camshaft CS2. Fluid chamber 118 is bounded at least in part by rotor 108, cap 116, and bolt 152.

Assembly 100 includes channel 156 and channel 158. At least a portion of channel 156 is bounded by bolt 152 in radially outward direction RD1. At least a portion of channel 156 is arranged to be bounded in radially inward direction RD2, opposite direction RD1, by camshaft CS1. At least a portion of channel 158 is bounded by bolt 122 in direction RD2. At least a portion of channel 158 is arranged to be bounded in direction RD1 by camshaft CS1. Channel 156 is directly connected to chamber 118. Channel 158 is directly connected to chamber 120.

Figure 10:
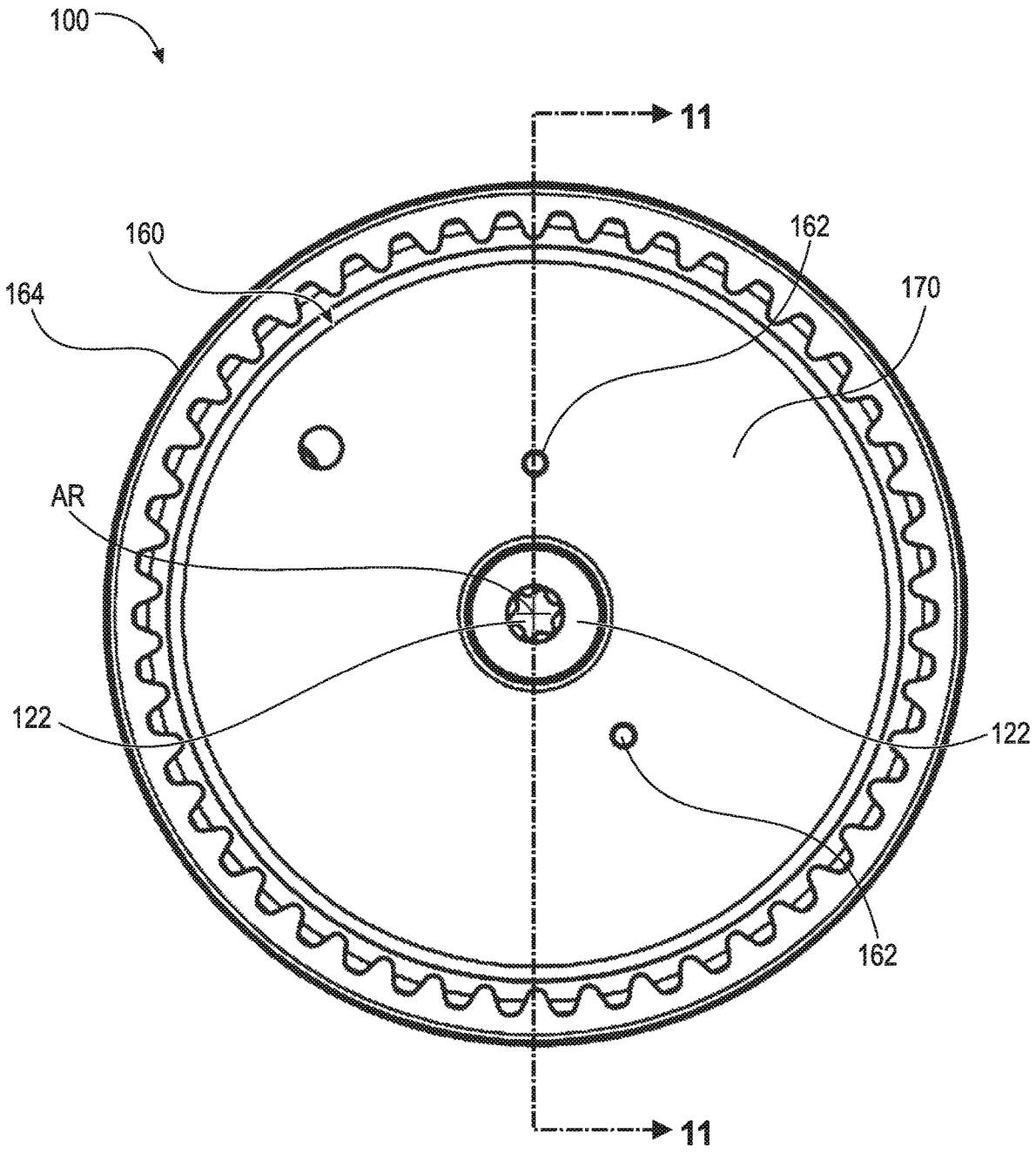
FIG. 10 is a front view of the camshaft phaser assembly shown in FIG. 1.

FIG. 10 is a front view of camshaft phaser assembly 100 shown in FIG. 1.

Figure 11:
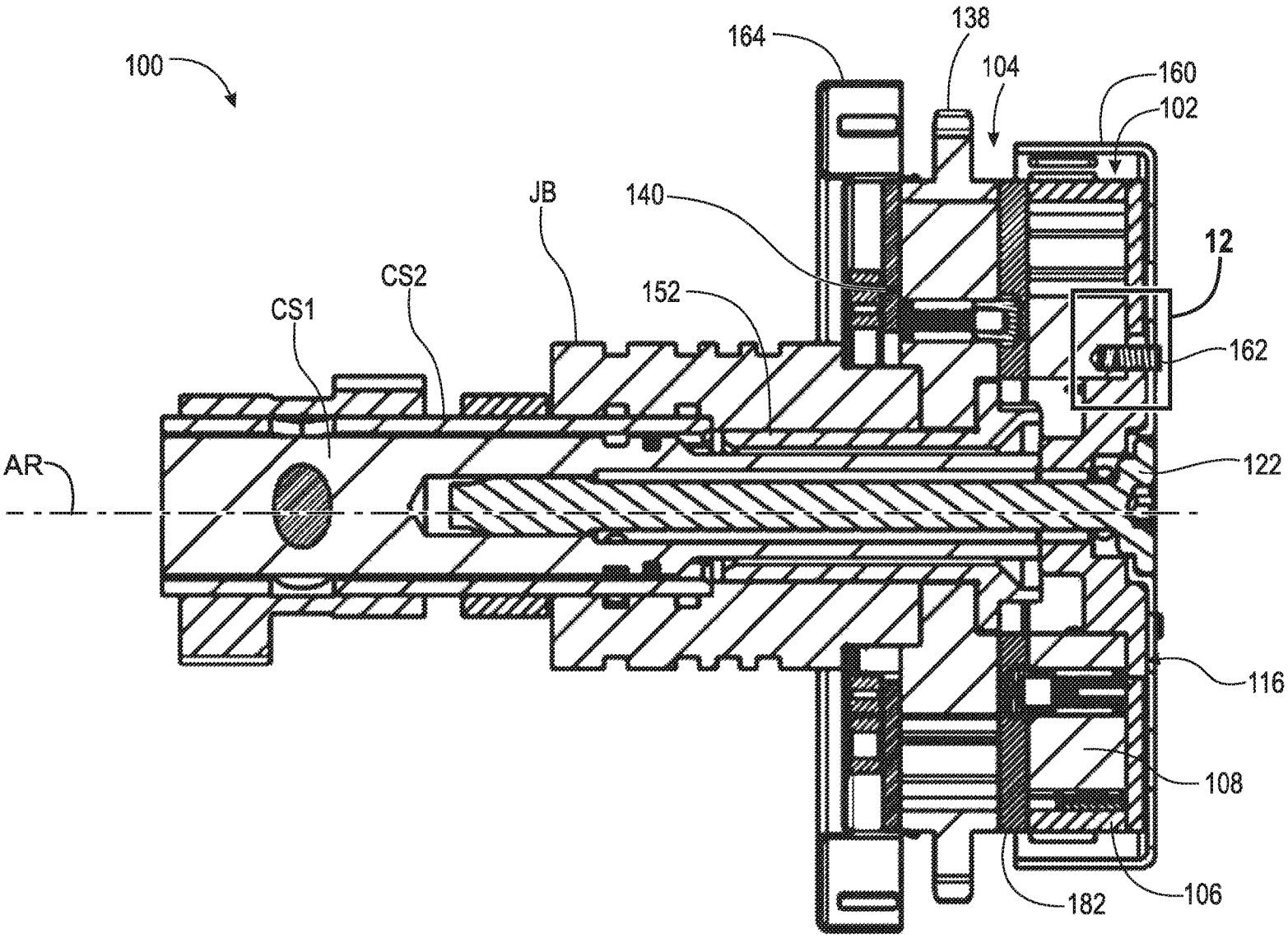
FIG. 11 is a cross-sectional view generally along line 11-11 in FIG. 10.

FIG. 11 is a cross-sectional view generally along line 11-11 in FIG. 10.

Figure 12:
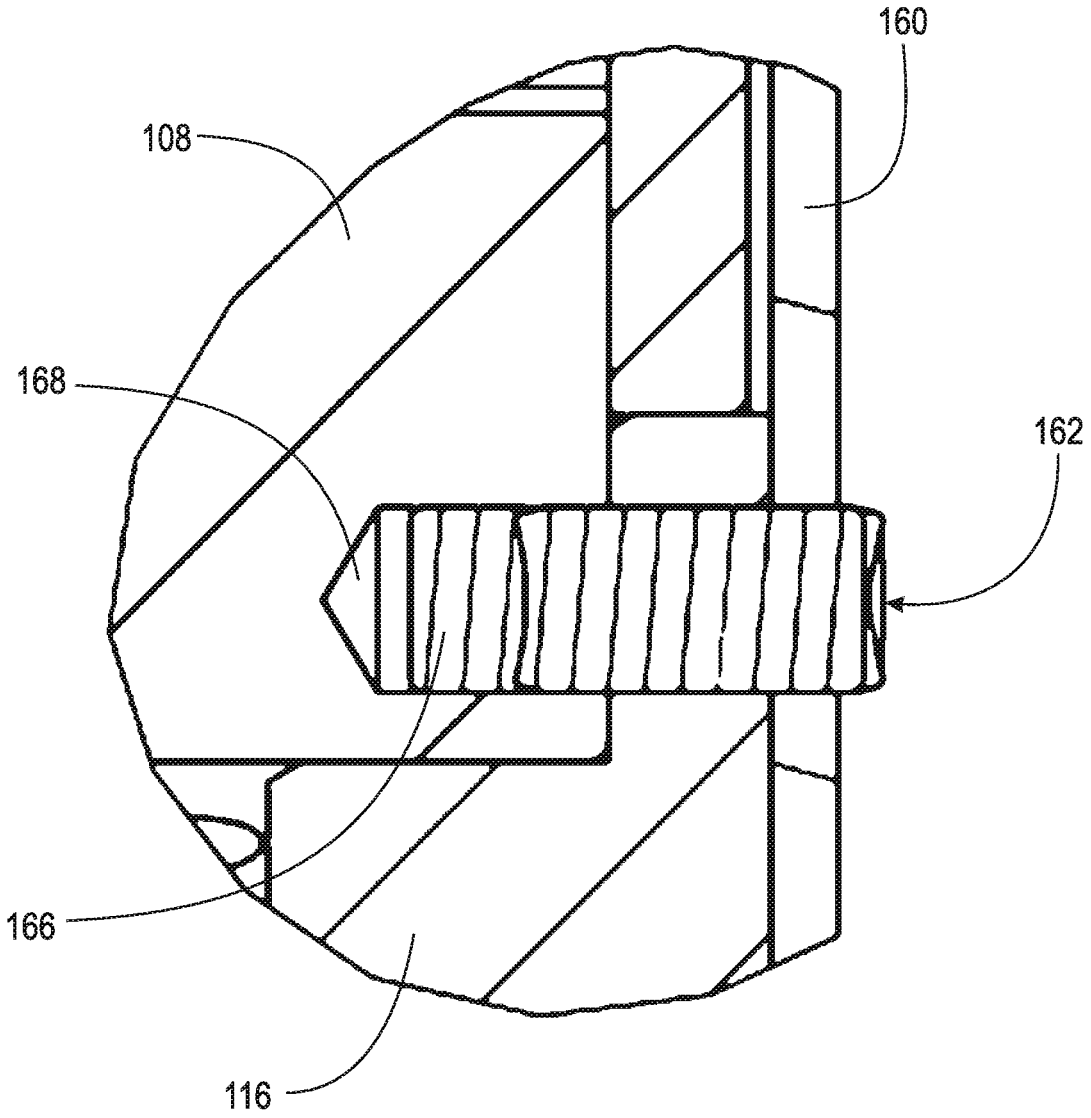
FIG. 12 is a detail of area 12 in FIG. 11.

FIG. 12 is a detail of area 12 in FIG. 11. The following should be viewed in light of FIGS. 1 through 12. Assembly 100 includes target wheel 160, pins 162, and target wheel 164. Pins 162 each pass through target wheel 160 and cap 116. Each pin 162 includes portion 166 disposed in a respective indent 168 in rotor 108. Pins 162 fix target wheel 160 to a predetermined position, for example a circumferential position, with respect to rotor 108. As is known in the art: target wheel 160 is used to determine a circumferential position of rotor 108 for use in rotating rotor 108, with respect to stator 106, to change a circumferential position of camshaft CS1 with respect to stator 106 (phasing camshaft CS1); and target wheel 164 is used to determine a circumferential position of rotor 140 for use in rotating rotor 140, with respect to stator 138, to change a circumferential position of camshaft CS2 with respect to stator 138 (phasing camshaft CS2). Pins 162 ensure that target wheel 160 is in the predetermined position upon which rotation of rotor 108 and phasing of camshaft CS1 is predicated.

Figure 13:
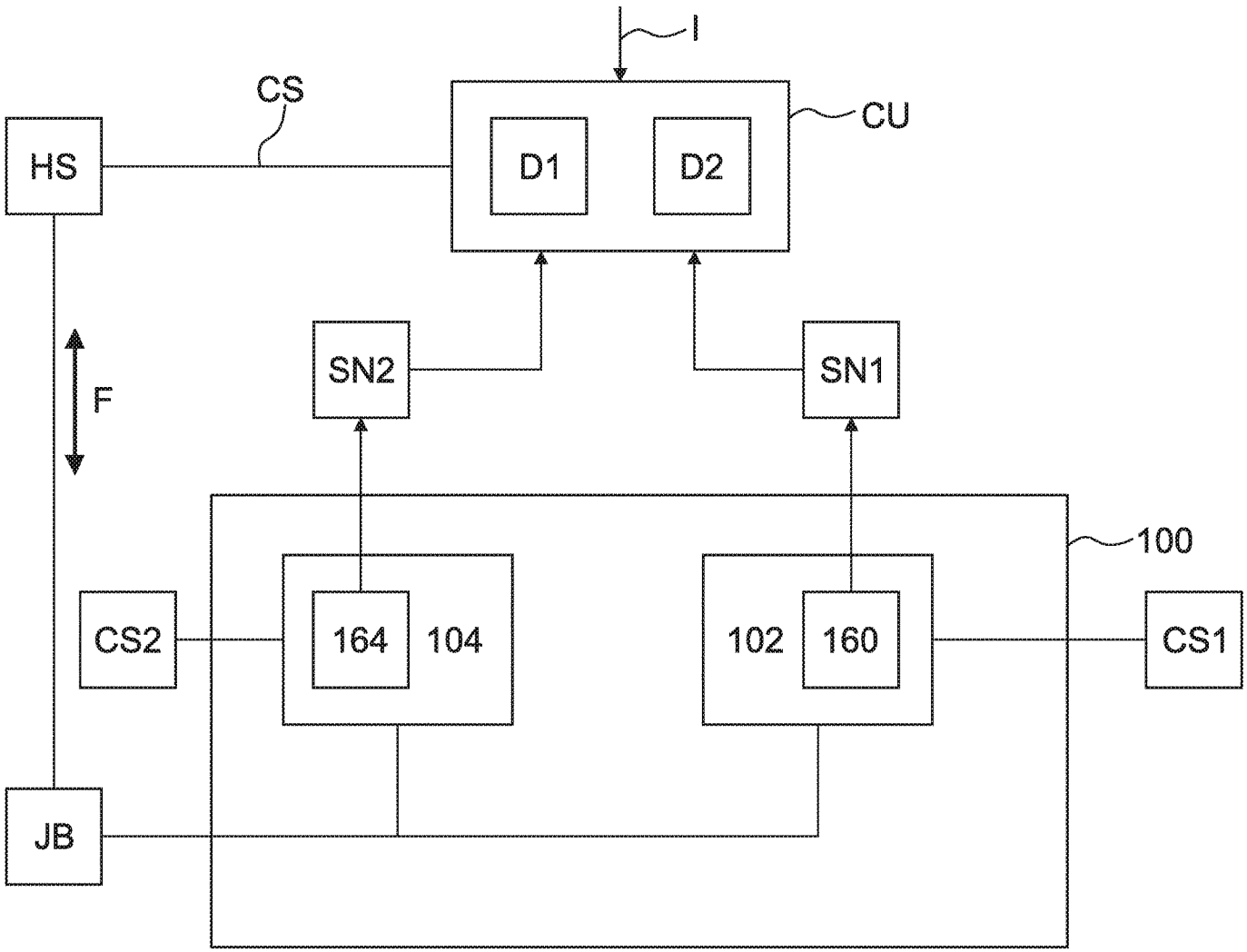
FIG. 13 is a schematic block diagram of a system including the camshaft phaser assembly shown in FIG. 1.

FIG. 13 is a schematic block diagram of a system including camshaft phaser assembly 100 shown in FIG. 1. The following should be viewed in light of FIGS. 1 through 13. FIG. 13 illustrates an example implementation of assembly 100 and target wheels 160 and 164.

Circumferential positions of target wheels 160 and 164 are read or measured by sensors SN1 and SN2, respectively. Sensors SN1 and SN2 transmit data D1 and D2 regarding the circumferential positions of target wheels 160 and 164, respectively, to control unit CU. Control unit CU uses data D1 and D1 and input I from other components as needed to send control signal CS for operation of hydraulic system HS, which controls transmission of fluid F to and from phasers 102 and 104. For example, if input I calls for camshaft CS1 to be advanced or retarded, data D1 is used as feedback to identify the required position of rotor 108 for advancing or retarding camshaft CS1.

Target wheel 160 and target wheel 164 are located at opposite axial ends of assembly 100. For example, radial portion 170 of target wheel 160 is located past rotor 108 in axial direction AD1. Axial direction AD1 is from bolt 152 toward cap 116 and parallel to axis of rotation AR. For example, radial portion 172 of target wheel 164 is located past rotor 140 in axial direction AD2, opposite axial direction AD1. Thus, cam shaft phaser 102 and cam shaft phaser 104 are axially disposed between, or axially bracketed by, target wheel 160 and target wheel 164. Stated otherwise, cam shaft phaser 102 and cam shaft phaser 104 are located between target wheel 160 and target wheel 164 in axial direction AD1.

Journal bearing JB is arranged to non-rotatably connect to camshaft CS2 and rotor 140. In an example embodiment: bearing JB includes through-bores TB1 and through-bores TB2; camshaft CS2 includes through-bores TB3 and through-bores TB4; and camshaft CS1 includes through-bores TB5. Each through-bore TB3 connects a respective through-bore TB1 to channel 156. In an example embodiment (not shown), cam shaft CS2 does not include through-bores TB3 and through-bores TB1 open directly to channel 156. Through-bores TB4 and TB5 connect through-bores TB2 and channel 158.

Rotor 140 includes multiple through-bores 174 and multiple through-bores 176. Each through-bore 174 opens to a respective chamber 146B. Each through-bore 176 opens to a respective chamber 146A. In an example embodiment, bearing JB includes: through-bores TB6 arranged to connect to through-bores 174; and through-bores TB7 arranged to connect to through-bores 176.

Channel 156 and channel 158 are arranged to transmit fluid F, for example oil, to and from chambers 114A and 114B, respectively. As is known in the art: supplying fluid F to chambers 114A and draining fluid F from chambers 114B rotates rotor 108 in direction CD1 with respect to stator 106, advancing the timing of camshaft CS1; and supplying fluid F to chambers 114B and draining fluid F from chambers 114A rotates rotor 108 in direction CD2 with respect to stator 106, retarding the timing of camshaft CS2.

Though-bores 174 and through-bores 176 are arranged to transmit fluid F to and from chambers 146A and 146B, respectively. As is known in the art: supplying fluid F to chambers 146A and draining fluid F from chambers 146B rotates rotor 140 in direction CD1 with respect to stator 138, advancing the timing of camshaft CS2; and supplying fluid F to chambers 146B and draining fluid F from chambers 146A rotates rotor 140 in direction CD2 with respect to stator 138, retarding the timing of camshaft CS1.

In the example of FIG. 1: stator 138 includes input gear 178 arranged to receive the rotational torque; phaser 104 includes bias spring 180; and assembly 100 includes locking cover 182 non-rotatably connecting stators 106 and 138, and axially disposed between rotors 108 and 140. That is, cover 182 is non-rotatably connected to stator 106 and stator 138. In an example embodiment (not shown), phaser 102 includes a bias spring.

Assembly 100 is more axially compact than known dual hydraulic camshaft phaser configurations. By placing target wheels 160 and 164 at axial ends of assembly 100: locking cover 182 is usable to connect stators 106 and 138, enabling the reduction in the axial extent of assembly 100; and rotors 108 and 140 are more accessible for cam timing.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

CD1 circumferential direction
CD2 circumferential direction
CS control system
CS1 camshaft
CS2 camshaft
CU control unit
D1 data
D2 data
F fluid
HS hydraulic system
I input
JB journal bearing
SN1 sensor
SN2 sensor
TB1 through-bore
TB2 through-bore
TB3 through-bore TB4 through-bore
TB5 through-bore
TB6 through-bore
TB7 through-bore
100 camshaft phaser assembly
102 hydraulic camshaft phaser
104 hydraulic camshaft phaser
106 stator
108 rotor
110 radially inwardly extending protrusion, stator
112 radially outwardly extending protrusion, rotor
114 phaser chamber
114A advance phaser chamber
114B retard phaser chamber
116 cap
118 fluid chamber
120 fluid chamber
122 bolt
124 through-bore, rotor
126 end, through-bore 124
128 end, through-bore 124
130 through-bore, rotor
132 end, through-bore 130
134 through-bore, cap
136 end, through-bore 134
137 surface, cap
138 stator
140 rotor
142 radially inwardly extending protrusion, stator
144 radially outwardly extending protrusion, rotor
146 phaser chamber
146A advance phaser chamber
146B retard phaser chamber
152 bolt
156 channel
158 channel
160 target wheel
162 pin
164 target wheel
166 portion, pin 162
168 indent
170 radial portion, wheel 160
172 radial portion, wheel 164
174 through-bore, rotor
176 through-bore, rotor
178 input gear
180 bias spring
182 locking cover

The invention claimed is:

1. A camshaft phaser assembly, comprising:
an axis of rotation;
a first hydraulic camshaft phaser including:
a first stator arranged to receive rotational torque and including a first plurality of radially inwardly extending protrusions;
a first rotor including a first plurality of radially outwardly extending protrusions circumferentially interleaved with the first plurality of radially inwardly extending protrusions; and,
a first plurality of phaser chambers, each phaser chamber included in the first plurality of phaser chambers, circumferentially bounded by:
a respective radially inwardly extending protrusion included in the first plurality of radially inwardly extending protrusions; and,
a respective radially outwardly extending protrusion included in the first plurality of radially outwardly extending protrusions;
a second hydraulic camshaft phaser;
a cap; and,
a first fluid chamber:
bounded in part by the cap; and,
in fluid communication with a first phaser chamber included in the first plurality of phaser chambers; and,
a first bolt arranged to non-rotatably connect the first rotor and the cap to a first camshaft.

2. The camshaft phaser assembly of claim 1, wherein the first rotor includes a through-bore connecting the first fluid chamber and the first phaser chamber.

3. The camshaft phases assembly of claim 1, wherein the first fluid chamber is bounded in part by the first bolt.

4. The camshaft phaser assembly of claim 1, wherein the cap includes a first through-bore:
open to the first fluid chamber; and,
in fluid communication with the first phaser chamber.

5. The camshaft phaser assembly of claim 4, wherein the first rotor includes a second through-bore connecting the first through-bore and the first phaser chamber.

6. The camshaft phaser assembly of claim 1, wherein:
the cap includes a surface facing the axis of rotation; and,
the surface bounds a portion of the first fluid chamber.

7. The camshaft phaser assembly of claim 1, wherein the first fluid chamber is bounded in part by the first rotor.

8. The camshaft phaser assembly of claim 7, wherein the first rotor includes a through-bore connecting the first fluid chamber and the first phaser chamber.

9. The camshaft phaser assembly of claim 1, further comprising:
a channel bounded, at least in part and in a radial direction, by the first bolt, wherein the channel:
extends past the first hydraulic camshaft phaser in an axial direction; and,
is in fluid communication with the first fluid chamber.

10. The camshaft phaser assembly of claim 9, wherein:
the first rotor includes a first through-bore open to the first phaser chamber; and,
the cap includes a second through-bore connecting the first through-bore and the first fluid chamber.

11. The camshaft phaser assembly of claim 1, wherein:
the second hydraulic camshaft phaser includes:
a second stator non-rotatably connected to the first stator and including a second plurality of radially inwardly extending protrusions;
a second rotor including a second plurality of radially outwardly extending protrusions circumferentially interleaved with the second plurality of radially inwardly extending protrusions;
a second plurality of phaser chambers, each phaser chamber in the second plurality of phaser chambers circumferentially bounded by:
a respective radially inwardly extending protrusion included in the second plurality of radially inwardly extending protrusions; and,
a respective radially outwardly extending protrusion included in the second plurality of radially outwardly extending protrusions, the camshaft phaser assembly further comprising:
a second bolt arranged to non-rotatably connect the second rotor to a second camshaft, wherein:
the first stator is non-rotatably connected to the second stator;

the first rotor is rotatable with respect to the first stator and the second rotor; and, the second rotor is rotatable with respect to the second stator and the first rotor.

12. The camshaft phaser assembly of claim 11, further comprising:

a first channel bounded, at least in part and in a first radial direction, by one of the first bolt or the second bolt, wherein:

the first channel is directly connected to the first fluid chamber; and, the first rotor includes a first through-bore in fluid communication with the first channel and the first phaser chamber.

13. The camshaft phaser assembly of claim 12, further comprising:

a second channel bounded, at least in part and in a second radial direction opposite the first radial direction, by the other of the first bolt or the second bolt; and, a second fluid chamber bounded in part by the cap and directly connected to the second channel, wherein the first rotor includes a second through-bore in fluid communication with the second channel and with a second phaser chamber included in the first plurality of phaser chambers.

14. The camshaft phaser assembly of claim 13, wherein:

the first channel is bounded, at least in part and in the first radial direction, by the first bolt; and, the second channel is bounded, at least in part and in the second radial direction by the second bolt;

the cap includes a third through-bore;

the first through-bore connects the first fluid chamber and the third through-bore; and, the second through-bore connects the second fluid chamber and the second phaser chamber.

15. The camshaft phaser assembly of claim 1, further comprising:

a first target wheel; and, at least one pin:

passing through the first target wheel and the cap;

including a portion disposed in the first rotor; and, non-rotatably fixing the first target wheel to a predetermined position with respect to the first rotor, wherein the first target wheel is arranged to determine a circumferential position of the first rotor for use in rotating the first rotor, with respect to the first stator, to change a phase of the first camshaft.

16. The camshaft phaser assembly of claim 15, further comprising:

a second target wheel, wherein:

the second hydraulic camshaft phaser includes:

a second stator non-rotatably connected to the first stator and including a second plurality of radially inwardly extending protrusions;

a second rotor including a second plurality of radially outwardly extending protrusions circumferentially interleaved with the second plurality of radially inwardly extending protrusions; and, a second plurality of phaser chambers bounded by the second plurality of radially inwardly extending protrusions and the second plurality of radially outwardly extending protrusions; the second target wheel is non-rotatably connected to the second rotor;

the second target wheel is arranged to determine a circumferential position of the second rotor for use in rotating the second rotor, with respect to the second stator, to change a phase of the second camshaft; and, the first hydraulic cam shaft phaser and the second hydraulic cam shaft phaser are axially disposed between the first target wheel and the second target wheel.

17. A camshaft phaser assembly, comprising:

an axis of rotation;

a first hydraulic camshaft phaser including:

a first stator arranged to receive rotational torque and including a plurality of radially inwardly extending protrusions;

a first rotor including a plurality of radially outwardly extending protrusions circumferentially interleaved with the plurality of radially inwardly extending protrusions; and, a plurality of phaser chambers, each phaser chamber, included in the first plurality phaser chambers, circumferentially bounded by:

a respective radially inwardly extending protrusion included in the plurality of radially inwardly extending protrusions; and, a respective radially outwardly extending protrusion included in the plurality of radially outwardly extending protrusions;

a second hydraulic camshaft phaser including:

a second stator non-rotatably connected to the first stator; and, a second rotor;

a cap including a first through-bore;

a first bolt arranged to non-rotatably connect the first rotor and the cap to a first camshaft;

a first fluid chamber:

bounded in part by the cap;

directly connected to the first through-bore; and, in fluid communication with a first phaser chamber included in the plurality of phaser chambers; and, a second fluid chamber:

bounded in part by the cap; and, in fluid communication with a second phaser chamber, circumferentially adjacent to the first phaser chamber, included in the plurality of phaser chambers.

18. The camshaft phaser assembly of claim 17, further comprising:

a second bolt arranged to non-rotatably connect the second rotor to a second camshaft concentric with the first camshaft;

a first channel bounded, at least in part and in a first radial direction, by the first bolt; and, a second channel bounded, at least in part and in a second radial direction opposite the first radial direction, by the second bolt, wherein:

the first rotor includes:

a second through-bore connecting the first phaser chamber and the first through-bore; and, a third through-bore connecting the second fluid chamber and the second phaser chamber;

the first fluid chamber connects the first channel and the first through-bore; and, the second fluid chamber connects the second channel and the third through-bore.

19. A camshaft phaser assembly, comprising:

an axis of rotation;

a first hydraulic camshaft phaser including:

a first stator arranged to receive rotational torque and including a first plurality of radially inwardly extending protrusions;

a first rotor including a first plurality of radially outwardly extending protrusions circumferentially interleaved with the first plurality of radially inwardly extending protrusions; and, a first plurality of phaser chambers circumferentially bounded by the first plurality of radially inwardly extending protrusions and the first plurality of radially outwardly extending protrusions;

a second hydraulic camshaft phaser including:

a second stator arranged to receive the rotational torque and including a second plurality of radially inwardly extending protrusions;

a second rotor including a second plurality of radially outwardly extending protrusions circumferentially interleaved with the second plurality of radially inwardly extending protrusions; and, a second plurality of phaser chambers circumferentially bounded by the second plurality of radially inwardly extending protrusions and the second plurality of radially outwardly extending protrusions;

a first target wheel:

non-rotatably connected to the first rotor; and, arranged to determine a circumferential position of the first rotor for use in rotating the first rotor with respect to the first stator; and, a second target wheel:

non-rotatably connected to the second rotor; and, arranged to determine a circumferential position of the second rotor for use in rotating the second rotor with respect to the second stator, wherein the first hydraulic camshaft phaser and the second hydraulic cam shaft phaser are located between the first target wheel and the second target wheel in an axial direction parallel to the axis of rotation.

20. The camshaft phaser assembly of claim 19, further comprising:

a cap including a first through-bore:

a first bolt arranged to non-rotatably connect the first rotor and the cap to a first camshaft;

a first fluid chamber bounded in part by the cap and the first bolt; and, a second fluid chamber bounded in part by the cap and the first rotor, wherein:

the first rotor includes a second through-bore and a third through-bore;

the second through-bore is in fluid communication with the first fluid chamber and with a first phaser chamber included in the first plurality of phaser chambers; and, the third through-bore connects the second fluid chamber and a second phaser chamber included in the first plurality of phase chambers.

* * * * *